United States Patent [19]

Sikander et al.

[11] Patent Number: 4,564,174

[45] Date of Patent: Jan. 14, 1986

[54] DEVICE FOR THE RECOVERY OF MERCURY

[75] Inventors: Åke Sikander; Åke Biörkman; Günther Jönsson, all of Karlskrona, Sweden

[73] Assignee: Lumalampan Aktiebolag, Karlskrona, Sweden

[21] Appl. No.: 618,927

[22] Filed: Jun. 11, 1984

Related U.S. Application Data

[62] Division of Ser. No. 442,767, Nov. 18, 1982, Pat. No. 4,468,011.

[30] Foreign Application Priority Data

Dec. 1, 1981 [SE] Sweden ..... 8107177

[51] Int. Cl.[4] ..... C22B 9/04

[52] U.S. Cl. ..... 266/149; 75/81; 266/89

[58] Field of Search ..... 266/149; 75/81

[56] References Cited

U.S. PATENT DOCUMENTS 1,671,964 6/1928 Breitwieser .

4,254,943 3/1981 Björkman .

*Primary Examiner*—Melvyn J. Andrews

*Attorney, Agent, or Firm*—Frishauf, Holtz, Goodman & Woodward

[57] ABSTRACT

This process enables the recovery of mercury from waste containing plastic material, e.g. batteries. The waste is slowly heated while an inert gas is being introduced in a vacuum for fractionating extraction of the products of the decomposition of the plastic. The waste gases must pass through an afterburner chamber incorporating a specially shaped burner where the plastic vapors are fully combusted. The waste gases are conducted from the afterburner chamber through a cooling trap and then through a cold trap in which the mercury is condensed and can be drained off. The final stage of the process is carried out in a pulsating vacuum by the inert gas.

The device in which the process takes place consists of a heated heat isolated treatment chamber (2), an afterburner chamber (6), a cooling trap (7), a cold trap (18) and a vacuum pump (23, 24) connected with pipelines (5, 12, 21). The system also includes a control unit (14) for regulating the operation of the vacuum pump (23, 24) and the settings of a shut-off valve (16) and a regulation valve (15) for the inert gas.

The plastic vapors are combusted in the afterburner chamber (6) by being heated in a flame basket produced with the aid of a concave flame cup (36) made of heat-resistant material.

15 Claims, 2 Drawing Figures

DEVICE FOR THE RECOVERY OF MERCURY

Figure 1:
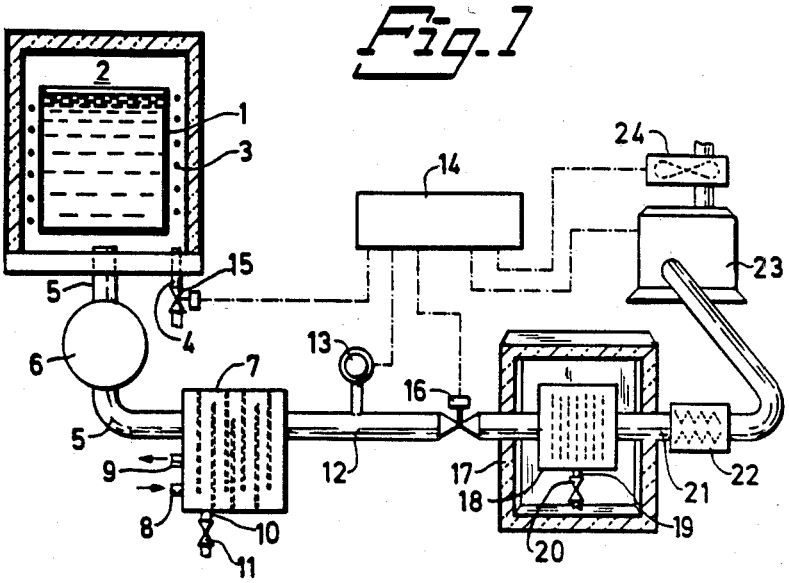

This is a division of application Ser. No. 442,767 filed Nov. 18, 1982, U.S. Pat. No. 4,468,011.

The invention in question concerns a means of recovering mercury, which exists in certain forms of waste, primarily waste incorporating plastic material. A special piece of equipment has been invented for the processing of this waste.

Today's society uses a large number of products containing some form of mercury. As these break down or are otherwise consumed, they are mixed with other forms of user waste. Even outside of certain professional groups in which the processing of mercury-containing products is common practice, an awareness of the need to recover mercury is growing. However, equipment with which to neutralize the mercury which is present in e.g. batteries has never existed before. In addition, there are virtually no companies who undertake to collect mercury-containing waste, apart from the Swedish Pharmacies, who accept batteries used in hearing aids.

As more and more products emerge like cameras, calculators and watches that are powered by mercury or mercury-oxide batteries, mercury, of course, spreads throughout society. Thus, the need to recover and neutralize mercury also grows. And as the technique employed for the purification of mercury is familiar and established in industry, there is full reason to recover mercury from waste as that described above, from amalgam used by dentists, from damaged instruments such as thermometers and barometers and burned-out lamps like luminescent powder lights and mercury vapour lamps. The application of the newly-invented device described below can allow mercury to be recovered economically.

The separation of mercury from non-organic waste is a method well established today. The waste is placed in a heated vacuum chamber connected with a vacuum pump by means of a pipe which passes through a cooling trap. The mercury is distilled in the vacuum chamber and then condensed in the cooling trap. The waste in the vacuum is rinsed using an inert gas. If mercury batteries are treated in a facility designed for this method, the condensate from plastic seals and the like will clog up the pipe and the cooling trap.

A plant for the destruction of mercury and other substances has been built in Denmark. It contains a rotary furnace measuring five meters in diameter and 20 meters in length. However, even though plastic material contained in batteries is pyrolytically decomposed in this plant, the mercury cannot be recovered. Up to now the waste ash from the furnace has still been contaminated with mercury upon its deposition. Thus, despite the face that the facility does possess a number of plants for the combustion of environmentally hazardous waste-products, it still lacks certain features.

Mercury batteries incorporate seals made of polystyrene or polyethylene. The batteries are encased with plastic-coated paper or a plastic film of e.g. PVC and are isolated. If such batteries are treated in the vacuum chamber and distillation plant described above, a pyrolysis of the plastic material takes place as the temperature is raised to the boiling point of mercury. Hence, most of the plastic evaporates but then condenses or sublimes in the pipes and the cooling trap. After a short period of use this phenomena will begin to cause operational problems and continued running of the facility will result in clogging of the plant necessitating cleaning. The material clogging the pipes are mercury-saturated coke-like deposits and a paste-like substance made of up to 95% mercury.

Draining the mercury from the cooling trap only yields some of it in the form of fluid metallic mercury. The rest, approx. 30 percent by weight of the separable mercury must be manually scraped out of the trap using a special tool. Moreover, the contents of the trap give off an awful-smelling odour and the fumes irritate the eyes and throat. A number of aromatic compounds have been traced by taking measurements using a DRAGER tube, such as benzene, toluole, xylene and styrene. This leads to substantially more complex handling procedures than when non-organic waste such as tooth amalgam or crushed light bulbs is purified in a plant.

The purpose of the invention in question is to devise a process and a device for the recovery of mercury from products which contain plastic material as well as mercury. This entails that the plastic be totally combusted so that all gases exhausted from the device consist solely of water vapour and carbon dioxide.

In order to treat e.g. mercury oxide batteries containing polyethylene plastic in combination with plastic paper, it is necessary to break down the organic material to light hydrocarbons which can subsequently be combusted to carbon dioxide and water vapour.

A charge consisting of about 100 kg of burned-out mercury oxide batteries is placed in a treatment chamber which can be subjected to a slight vacuum, around −0.05 bar. The charge contains less than 10 percent by weight plastic material and graphite.

Once the vacuum has been introduced in the treatment chamber, it is maintained by means of a fan or vacuum pump while nitrogen gas is continuously fed into the treatment chamber. Concurrently, the charge is heated up to 200° C. at a rate of about 5° C. per minute. The polyethylene seals melt at about 130° C. causing some of the batteries to open while others subsequently explode due to the inner pressure caused by the high heat. This renders some of the metallic mercury accessible for distillation.

Waste gases from the charge are conducted to an afterburner chamber and through a flame-basket burner centrally positioned in the chamber. When the temperature in the chamber has reached 200° C. and the burner is lit and has been lit for about five minutes, the temperature in the treatment chamber is raised to 415° C. at a rate of 5° C./minute and maintained at that temperature for about one and a half hours.

At temperatures above 200° C. the organic material in the charge begins to decompose. As in the initial phase of the treatment process, the atmosphere in the treatment chamber primarily consists of nitrogen gas at an absolute pressure of 0.95 bar (=vacuum−0.05 bar). Thus the process is principally a thermal decomposition (pyrolysis) and to a lesser extent a thermal oxidative decomposition.

A number of factors determine the substances formed in the decomposition of polymers such as temperature, pressure, atmosphere, rise in temperature per time unit, effects of other substances included in the system, e.g. additive for stabilizing the plastic etc.

The decomposition of polyethylene at 300–500° C. (temperature rise of approx. 5° C. per minute).

| Thermal in inert atmosphere | | Thermal oxidative in air | |
|---|---|---|---|
| $P_{abs}$ | 0.95 bar | $P_{abs}$ | 0.95 bar |
| ethane | ethylene | Carbon monoxide | carbon dioxide |
| propane | propylene | Butyraldehyde | valeraldehyde |
| butane | butylene | Ethylene | propylene |
| pentane | 1-pentylene | 1-butylene | 1.3 pentadien |
| hexane | 1-hexylene | 1-hexylene | |
| n-heptane | 1-octylene | methane | |
| Total about 30 substances | | Total about 50 substances | |

While the temperature is being raised to 415° C., the exhaust gases are drawn from the treatment chamber through the afterburner chamber by the vacuum inducer. The gases pass through the central through-pipe of the burner and into the flame basket. This is conical in shape and terminates at the base in a hyperboloid-shaped, vertically adjustable cup made of heat resistant material such as beryllium oxide. By the time the exhaust gases have passed through the flame curtain of the flame basket their velocity has dropped to between one fifth and one twentieth of what it was in the burner through-pipe. By now the temperature of the gas has reached 1500–2000° C. depending on whether the burner is operating on an LP gas/air mixture or a hydrogen gas/air mixture. At this temperature the fluid substances which form part of the waste gases from the treatment chamber decompose via the formation of free radicals in simpler hydrocarbons, carbon monoxide and nitrogen followed by a total combustion into carbon dioxide and water vapour, provided the proper amount of oxygen is present. A shortage of oxygen leads to slower decomposition (fewer peroxide radicals) and to incomplete combustion with toxic carbon monoxide in the waste gases.

The shape of the cup mentioned above causes the gases discharged from the treatment chamber to blend in such a way that prior to passage through the flame basket they have virtually attained the same high temperature as the burner flames, whereupon the molecular chains in the free radicals are cleaved.

For the purposes of designing and sizing the afterburner chamber it is imperative to know which decomposition products are formed and in what quantities these will be combusted per time unit. A calculation based on the assumption that 1 kg of polyethylene plastic is broken down in the treatment chamber most of which is transformed into 1-hexylene, 1-pentylene, propane and propylene, is made using the formula given below. According to this, the thermal decomposition rate is determined for polyethylene polymers in a vacuum and a rough estimate is made of the decomposition of polyethylene plastic in the conditions prevailing in the treatment chamber.

$$K = A \cdot e^{-\frac{E}{RT}}$$

K = rate constant ($S^{-1}$)
A = Arrhenius factor ($S^{-1}$)
E = activation energy ($KJ \cdot mol^{-1}$)
R = gas constant ($8.314\ J \cdot {}^{\circ}K \cdot mol^{-1}$)
T = temperature (°K)

By means of this calculation method and experiments conducted it has been found that polyethylene plastic decomposes in a vacuum at a rate of 1% per minute at 415° C. Hence it takes about an hour and a half to break down 1 kg of polyethylene plastic at a temperature of 415° C. In actual operating conditions, the process in the treatment chamber would cause the polyethylene to decompose at a rate of 10–15 g a minute which corresponds to a gas flow of 6–9 liters/min. With this gas flow and coupled with continuous feeding of nitrogen gas (NTP) of 0.5 l/min, the total gas flow obtained is about 10 l/min.

In order to maintain a temperature of 1500–2000° C. in the walls of the gas trap (flame cone and flame cup) as well as retaining a closed volume from which the specified gas in the charge cannot escape without complete combustion, the following gas flows to the burner are required:

LP gas: 0.2–0.3 $m^3/h$ (NTP)
Air: 5–8 $m^3/h$ (NTP)

This entails that the velocity of the gas in the centre orifice of the burner must be set so that a given ratio is achieved in relation to the velocity of the exiting gas through the surface of the flames basket. This ratio, which is also the ratio between the gas velocities, should be around 1:20.

It has been proven that the best way of attaining a uniform temperature distribution over the entire surface of the flame cup, is to give the cup a semi-spherical to hyperbolic shape by which means the circular front of the flame basket curves in towards the centre.

While the gases emitted from the plastic material in the batteries are being neutralized, mercury vapour is being given off from the charge. When the boiling point of mercury (356.58° C.) has been exceeded, most of the mercury in the batteries boils out. The mercury vapour is conducted through a water-cooled labyrinth trap in which it condenses. Nevertheless, some of the vapours pass through this trap and condense in a downstream cold trap incorporated in a freeze cabinet. In order to separate out any remains of the plastic material from the batteries which have not decomposed, gases discharged from the cold trap pass through a gas filter before they are conducted out into the open air via the pressure reducing devices.

After a temperature of 415° C. has been maintained for an hour and a half, the burner in the afterburner chamber is extinguished whereupon the pressure in the treatment chamber is lowered to −0.9 bar for effecting the mercury extraction process separately. The temperature in the treatment chamber is raised to 510° C., while the supply of nitrogen gas is regulated so that the pressure in the treatment chamber is permitted to rise slowly to −0.5 bar and then drop to between −0.75 and −0.95 bar, twice an hour. These fluctuations in pressure force out any mercury remaining inside the batteries. The process continues in this manner for a period of four hours. The temperature in the treatment chamber during this period is regulated so that any amalgams of Pb, Cd, Ag, Sn and Zn formed are broken down and the mercury liberated for distillation.

At the conclusion of the process time, the supply of heat to the treatment chamber is interrupted and the pressure is slowly permitted to rise to atmospheric pressure. Chemical analysis of the remains of the batteries has revealed that on average, the amount of Hg residue remaining is below 50 ppm, allowing them to be dumped directly in a garbage dump.

A description of a selected design of a device for effecting the procedure described above will be given below. Reference numbers apply to the appended diagram.

FIG. 1 presents a schematic diagram of the device

Figure 2:
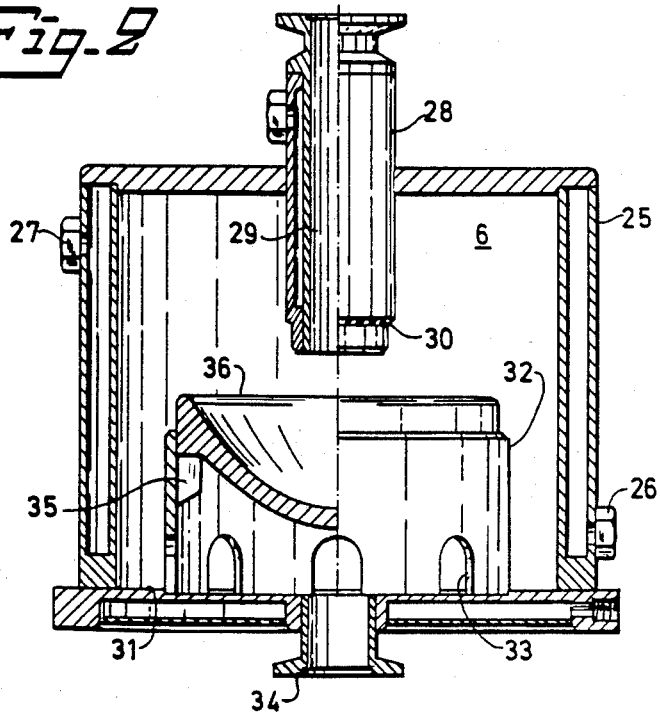

FIG. 2 presents a vertical cross-section of the afterburner chamber shown in FIG. 1, and a partial cross section of the flame-basket burner.

A vessel (1) in which sits a charge of the waste, containing the plastic material which is to be purified from mercury, is placed in a heat isolated treatment chamber (2). This chamber, which is effectively sealed, is equipped with a heating device in the form of e.g. electrical resistant elements (3), and an inlet (4) for an inert gas, such as nitrogen. A waste gas line (5) runs from the treatment chamber (2) and incorporates an afterburner chamber (6) described in detail below. The line (5) continues to a cooling trap (7), e.g. of the labyrinth type, in which gases conducted through the line (5) are cooled by means of water which is supplied to the cooling trap through an inlet (8). The jacket for the cooling trap (7) incorporates an outlet (9) through which the now heated cooling water runs for further circulation through radiators in order to recover the heat from the water. A drain pipe (10) onto which is fitted a shut-off valve (11) runs from the bottom of the cooling trap (7). The mercury condensed in the cooling trap (7) runs out through the drain pipe (10) and is subsequently refined and resold as new mercury.

A pressure sensing device (13) is connected to a line (12) running from the cooling trap (7). This device transmits signals to a control unit (14) which regulates a needle valve (15) in the gas inlet (4) to the treatment chamber (2). A shut-off valve (16) is also positioned in the line (12) and is actuated by the control unit (14). The shut-off valve (16) is kept closed when an inert gas is fed in through the needle valve (15) and is opened when waste gases from the treatment chamber are removed from the facility by means of the vacuum inducing device.

The line (12) runs from the shut-off valve (16) to a cold trap (18) located in a freeze cabinet (17). Mercury which was not separated in the cooling trap (7) is condensed here, as well as any remaining plastic material which wasn't combusted into carbon dioxide and water vapour in the afterburner chamber (6). The cold trap (18) possesses a drainage pipe (19) which in turn is fitted with a shut-off valve (20) in order to process the separated mercury in the same manner as in the cooling trap (7).

A final exhaust gas line (21) runs from the cold trap (18) and incorporates a gas filter (22) for final purification of the gases discharged from the facility. The waste gas line (21) terminates in a vacuum pump on which is mounted a fan (24) for maintaining the lower vacuum necessary in the initial stages of the process.

Besides opening and closing the needle valve (15) and shut-off valve (16), the control unit (14) also regulates the operation of the vacuum pump (23) and the fan (24). The fan (24) lowers the pressure of the entire facility while a limited amount of inert gas is fed in through the needle valve (15). When the plastic material contained in the charge in the treatment chamber (1) has been vapourized, the vacuum pump (23) is started up to lower the pressure throughout the facility to −0.9 bar. The control unit (14) then shuts off the valve (16) and signals the needle valve (15) to slowly feed in the inert gas until a pressure of, in this case, −0.5 bar has been attained. The control unit (14) then starts up the vacuum pump (23) whereupon the shut-off valve (16) opens and the pressure in the facility can again be lowered to −0.9 bar. The control unit (14) can be set to the desired number of cycles per time unit.

The afterburner chamber mentioned above (6) is constructed as follows. The chamber is encased in a double jacket (25) preferably with a circular space in which a circulating cooling medium passes from an inlet (26) to an outlet (27). A flame-basket burner (28) is inserted vertically through the roof of the chamber. A channel (29) running centrally through the burner (28) is for conducting the waste gases from the treatment chamber (2) to the afterburner chamber (6). A ring with holes (30) is fitted directly behind the mouth of the channel (29). The holes are bored at a sharp angle to the axis of the burner (28). A mixture of gas and air flows through the holes to burn in a number of flames together forming a conical basket-shaped flame. The conicality of the flame-basket is determined by the angle of the holes (30) to the centreline of the burner.

A sleeve-shaped support (32) with ports (33) along its lower edge sits on the bottom (31) of the afterburner chamber. The bottom is jacketed to allow for the circulation of the cooling medium. The ports (33) open into the support (32) and permit free passage to a discharge pipe (34) positioned in the bottom (31) and which forms an outlet for the gases treated in the afterburner chamber. Adjustable support cleats (35) have been fitted to the inside of the support (32) and on these rests a flame cup (36) made of a heat resistant material such as beryllium oxide. The inside of the cup (36) is virtually semi-spherical, suitably with a hyperbolic cross section. In this manner the flames in the flame basket are induced to bend inwards in the middle of the afterburner chamber (6) where the gases exiting from the treatment chamber (2) are rapidly mixed with the combustion gases from the burner (28). As a consequence, the products of the decomposition of the plastic material to be combusted are heated almost to the temperature of the flames in the flame basket, 1500–2000° C. In this temperature range and through the gas flow generated in the flame basket, the products of the decomposition of the plastic material from the charge are completely combusted.

Since the flame cup (36) is vertically adjustable, the size of the surface of the flame basket can be varied. This means that the ratio between the gas velocity in the channel (29) and the gas velocity out through the flame basket can be regulated. Depending on the plastic material included in the charge, it could be worthwhile to select a ratio of between 1:5 and 1:20. Naturally, the volume of the combustion gas supplied to the burner (28) must be adapted to the setting of the flame cup (36), but this is done in the known manner.

We claim:

1. Apparatus for recovering mercury from waste containing plastic material by distilling the mercury from the waste, comprising:

a treatment chamber (2) for receiving the waste;

inlet means (4) for supplying inert gas into said treatment chamber, said inlet means including a controllable inlet valve (15) for regulating the inert gas supplied to said treatment chamber (2);

means in said treatment chamber for first heating the waste to about 200° C. in a slight vacuum and with a limited supply of said inert gas, and for subsequently heating the waste to temperatures higher than 200° C.;

a discharge line (5, 12) coupled to said treatment chamber (2) for discharging gases emitted by the heated waste material in said treatment chamber, said discharged gases containing organic decomposed products;

an afterburner chamber (6) coupled in said discharge line (5, 12) for combusting said discharged gases from said treatment chamber;

cold trap means (7, 18) coupled in said discharge line (5, 12) downstream of said afterburner chamber (6) for receiving gases exhausted from said afterburner chamber (6);

a selectively operable vacuum pump (23) coupled to said discharge line (5, 12) downstream of said cold trap means (7, 18) for drawing said gases from said treatment chamber through said afterburner chamber (6) and through said cold trap means (7, 18);

shut-off valve means (16) in said discharge line (5, 12) upstream of said vacuum pump (23) for selectively opening and closing said discharge line (5, 12);

control means (14) coupled to said vacuum pump (23), to said inlet valve (15), and to said shut-off valve means (16) for selectively opening and closing said shut-off valve means (16) and said inlet valve, and for selectively controlling operation of said vacuum pump (23).

2. The apparatus of claim 1, wherein said control means is further coupled to said heating means in said heat treatment chamber for regulating the heating of the waste in said treatment chamber in accordance with an adjustable program.

3. The apparatus of claim 2, wherein said control means controls the heat in said heat treatment chamber so as to rise to about 415° C. during burning of said discharged gases in said afterburner chamber (6), and for increasing the temperature in said treatment chamber to about 510° C. after the plastic material in said waste material in said treatment chamber is completely broken down.

4. The apparatus of claim 3, wherein said control means controls said inlet valve (15) to cause the pressure of the inert gas in said treatment chamber to pulsate at a predetermined rate.

5. The apparatus of claim 1, wherein said control means controls said inlet valve (15) to cause the pressure of the inert gas in said treatment chamber to pulsate at a predetermined rate.

6. The apparatus of claim 1, wherein said control means actuates said shut-off valve (16), said inlet valve (15) and said vacuum pump (23) in a given sequence such that the vacuum in said treatment chamber (2) is induced to pulsate at a predetermined number of cycles per hour.

7. The apparatus of claim 1, wherein said cold trap means (7, 18) comprises a first cold trap (7) and a second cold trap (18) downstream of said first cold trap (7), said shut-off valve means (16) being arranged between said first and second cold traps.

8. The apparatus of claim 7, comprising a pressure sensing means (13) coupled to said discharge line between said first and second cold traps, said pressure sensing means (13) being coupled to said control means (14) for transmitting signals corresponding to the pressure in said discharge line (5, 12) to said control means (14).

9. The apparatus of claim 8, wherein said control means (14) is responsive to said pressure sensing means (13) for controlling said inlet valve (15) to control the feed of inert gas to said treatment chamber (2).

10. The apparatus of claim 9, wherein said control means closes said shut-off valve (16) when it actuates said inlet valve (15) to feed said inert gas to said treatment chamber (2).

11. The apparatus of claim 10, wherein said control means (14) opens said shut-off valve (16) when waste gas from said treatment chamber (2) are removed from said discharge line (5, 12) by said vacuum pump (23).

12. The apparatus of claim 11, further comprising an exhaust gas line (21) coupling said vacuum pump (23) to said discharge line (5, 12) for exhausting gas to the outside.

13. The apparatus of claim 1, further comprising a fan (24) coupled to said control means (14) for lowering the pressure of the entire facility in which said apparatus is located.

14. The apparatus of claim 13, wherein said control means operates said fan (24) to lower said pressure of said facility while inert gas is fed into said treatment chamber (2) through said inlet valve (15).

15. The apparatus of claim 1, wherein said control means operates said vacuum pump (23) to lower the pressure to about −0.9 bar. When plastic material in said treatment chamber (2) has vaporized; said control unit then shutting off said shut-off valve (16) and opening said inlet valve (15) for slowly feed inert gas into said treatment chamber (2) until a predetermined pressure has been attained; said control means then operating said vacuum pump (23) and opening said shut-off valve (16) so that said pressure again is lowered to about −0.9 bar.; said control means repeating said operations at a predetermined number of cycles per unit of time.

* * * * *

UNITED STATES PATENT AND TRADEMARK OFFICE

CERTIFICATE OF CORRECTION

PATENT NO. : 4,564,174

DATED : January 14, 1986

INVENTOR(S) : Åke SIKANDER et al

It is certified that error appears in the above-identified patent and that said Letters Patent is hereby corrected as shown below:

COLUMN 3, line 29, after "radicals" change "in" to --into--.

Signed and Sealed this

*First* Day of *July 1986*

[SEAL]

*Attest:*

DONALD J. QUIGG

*Attesting Officer*

*Commissioner of Patents and Trademarks*